United States Patent [19]

Huang et al.

[11] Patent Number: 5,046,561

[45] Date of Patent: Sep. 10, 1991

[54] APPLICATION OF MULTIPHASE GENERATION PROCESS IN A $CO_2$ FLOOD FOR HIGH TEMPERATURE RESERVOIRS

[75] Inventors: Wann-Sheng Huang, Houston; Jack J. Hsu, Stafford, both of Tex.

[73] Assignee: Texaco Inc., White Plains, N.Y.

[21] Appl. No.: 492,006

[22] Filed: Mar. 12, 1990

[51] Int. Cl.[5] ..... E21B 43/22

[52] U.S. Cl. ..... 166/273; 166/274

[58] Field of Search ..... 166/273, 274, 275, 268, 166/252

[56] References Cited

U.S. PATENT DOCUMENTS 4,513,821 4/1985 Shu ..... 166/302 X
4,617,996 10/1986 Shu ..... 166/273
4,678,036 7/1987 Hartman et al. ..... 166/274 X
4,766,558 8/1988 Luks et al. ..... 166/274 X
4,846,276 7/1989 Haines ..... 166/274 X

*Primary Examiner*—Stephen J. Novosad
*Attorney, Agent, or Firm*—Jack H. Park; Kenneth R. Priem; Russell J. Egan

[57] ABSTRACT

A high temperature reservoir is preconditioned by injection of cold water until a zone around the injection well reaches a temperature suitable for multiphase generation conditions. A subsequent carbon dioxide injection creates a multiphase slug near the wellbore region. The multiphase slug is propagated through the reservoir by continued injection of $CO_2$ or water alternating with gaseous $CO_2$.

10 Claims, 2 Drawing Sheets

SLIMTUBE RESULTS FOR A $CO_2$ DISPLACEMENT AT LOW TEMPERATURE (< 120°F)

SLIMTUBE RESULTS FOR A $CO_2$ DISPLACEMENT AT HIGH TEMPERATURE (> 120°F)

SLIMTUBE RESULTS FOR A $CO_2$ DISPLACEMENT AT LOW TEMPERATURE (< 120°F)

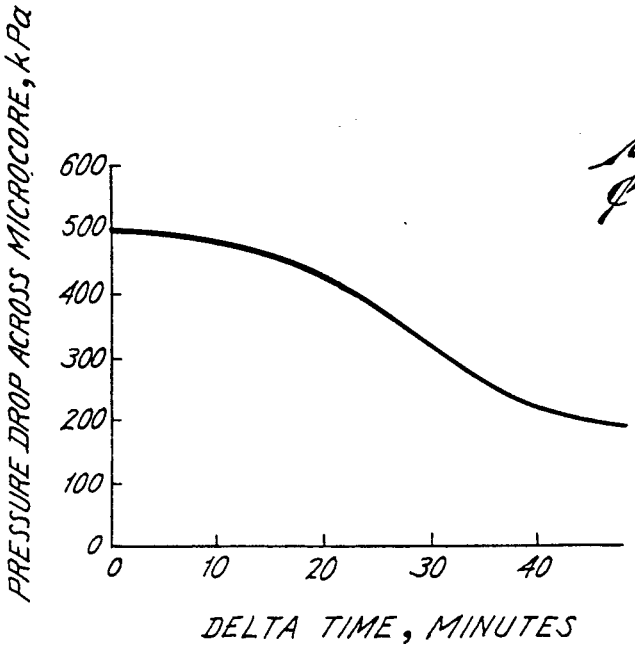
PRESSURE DROP HISTORY FOR A $CO_2$-OIL TRANSITION ZONE ABOVE THE THREE-PHASE REGION (AFTER REF. 2)
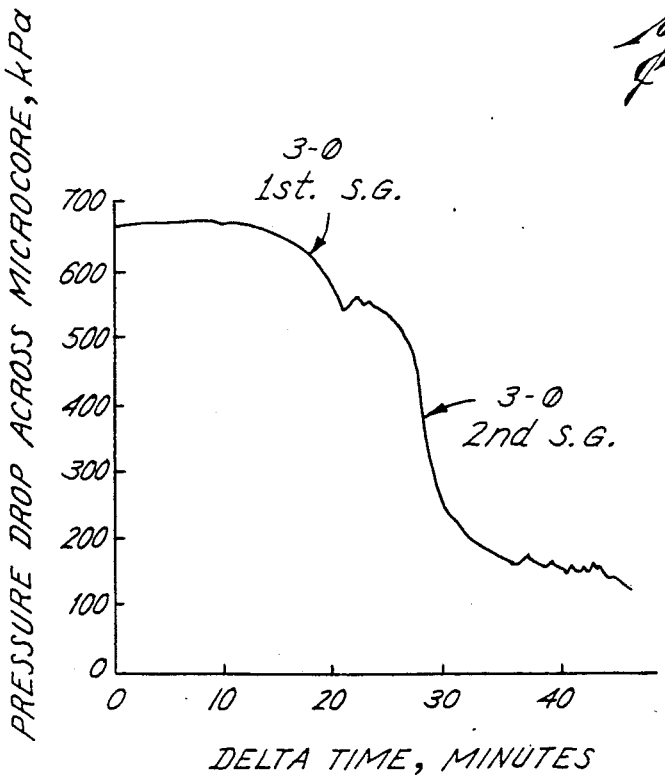
PRESSURE DROP HISTORY OF A $CO_2$-OIL TRANSITION ZONE IN THE THREE-PHASE REGION (AFTER REF. 2)

APPLICATION OF MULTIPHASE GENERATION PROCESS IN A $CO_2$ FLOOD FOR HIGH TEMPERATURE RESERVOIRS

THE FIELD OF THE INVENTION

The present invention pertains to a method for converting an immiscible $CO_2$ flood to a $CO_2$ flood at multiphase generation conditions in a hot reservoir.

1. CROSS-REFERENCE TO RELATED APPLICATION

The present application is related to our copending patent application, Ser. No. 492,013, titled "Method For Converting An Immiscible Flood To A Miscible Flood", filed on even date herewith.

2. THE PRIOR ART

There has been a great deal of research in the past thirty years toward improving oil recovery efficiency of conventional lean gas injection. Earlier gases used for this procedure were natural occurring or natural hydrocarbon gases enriched with liquified petroleum gases. This research lead to classification of three basic groups of hydrocarbon miscible slug processes which use a solvent bank to displace oil miscibly. A liquified petroleum gas slug flood injects a liquid solvent slug into the reservoir. The condensing or enriched gas drive creates a miscible bank in the reservoir from condensed hydrocarbon components of a rich solvent mixed with oil. Vaporizing or high-pressure gas drive creates a miscible bank from a lean solvent mixed with vaporized hydrocarbon components of the oil. If the miscible bank deteriorates, or never forms, the flood is termed immiscible.

Increased prices for hydrocarbons and their products prompted further investigations for suitable substitutes for hydrocarbon gases in injection processes. Virtually any gas may be used for a pressure maintenance program or immiscible gas displacement; however, sulfur dioxide ($SO_2$), hydrogen sulfide ($H_2S$) and carbon dioxide ($CO_2$) were found to be effective substitutes for miscible displacement processes. Of these three compounds, $CO_2$ is preferable because it is a non-toxic material and is available in relatively large quantities throughout the entire country. Carbon dioxide behaves similarly to normal, light, paraffin hydrocarbons in its ability to displace oil miscibly, but differs from them in its physical and chemical properties. Carbon dioxide is a nonpolar compound with a molecular weight close to that of propane and since its critical temperature is 88° F., it is normally a gas at reservoir conditions. Studies have established that $CO_2$ displaces oil effectively by both immiscible and miscible mechanisms. Immiscible $CO_2$ drive involves gas expansion, oil swelling, viscosity reduction and vaporization. Recovery by gas expansion is less than 20% oil in place while recoveries by the other immiscible mechanisms are typically less than 50% oil in place but can be appreciably higher for suitable reservoir systems. Miscible $CO_2$ drive, the preferred displacement mechanism, involves in situ generation of a miscible solvent similar to hydrocarbon vaporizing gas drive. Recoveries by miscible $CO_2$ drive typically exceed 80% oil in place.

There are basically two physical factors which determine miscibility of a given oil with a given solvent in a formation, namely temperature and pressure. It is extremely difficult to do anything about increasing pressure in a reservoir over the reservoir pressure limit because of all the fissures which would allow escape of fluids under increased pressure, however, pressure maintenance is possible since this more or less continues the original conditions. This leaves temperature control as a therefore unaddressed possibility for improving miscibility of oil and solvent in a formation.

Oil recovery by immiscible $CO_2$ flooding with oil swelling and viscosity reduction effects have been around since the 1950's. Carbonated waterflood processes were developed in the 1960's. However, miscible $CO_2$ flooding did not receive widespread attention until the early 1970's. Most field applications were attempts to achieve miscible displacement and to improve volumetric sweep efficiencies in hydrocarbon flood projects.

Studies on $CO_2$ and miscibility can be found in "Determination and Prediction of $CO_2$ Minimum Miscibility Pressures" Yellig et. al., Journal of Petroleum Technology, January 1980 pp. 160–168; "Multiple-Phase Generation During Carbon Dioxide Flooding" Henry et. al., Society of Petroleum Engineers Journal, August 1983, pp. 595–601; "Phase Behavior of Several $CO_2$-West Texas Reservoir Oil Systems" Turek et. al., Society of Petroleum Engineers, Sept. 1984 SPE 13117; "Laboratory Design of a Gravity Stable, Miscible $CO_2$ Process" Cardenas et. al., Society of Petroleum Engineers, Oct. 1981 SPE 10270; and "Implementations of a Gravity Stable, Miscible $CO_2$ Flood in the 8000-Foot Sand, Bay St. Elaine Field," Palmer et. al., Society of Petroleum Engineers, Oct. 1981 SPE 10160.

SUMMARY OF THE PRESENT INVENTION

The present invention is a method for improving recovery of hydrocarbon products from a high temperature formation, a portion of which surrounding an injection well has been cooled to a temperature at which the reservoir can operate at multiphase generation conditions. The subsequent $CO_2$ flood will be more efficient with the advantages of decreased minimum miscibility pressure, decreased $CO_2$ consumption, prolonged gas breakthrough time and improved oil recovery efficiency.

BRIEF DESCRIPTION OF THE DRAWINGS

The present invention will be described by way of example with reference to the accompanying drawings, in which:

FIG. 3 is a graph showing pressure drop history for a carbon dioxide-oil transition zone above the three phase region; and FIG. 4 is a similar graph showing pressure drop history in the three phase region.

DETAILED DESCRIPTION OF THE PREFERRED EMBODIMENT

It has been observed that the minimum miscibility pressure of a carbon dioxide flood linearly increases up to 200° F. temperature. For example, the minimum miscibility pressure of an oil was 1,150 psia at 95° F.; 1,875 psia at 150° F.; and 2,350 psia at 192° F.

Figure 1:
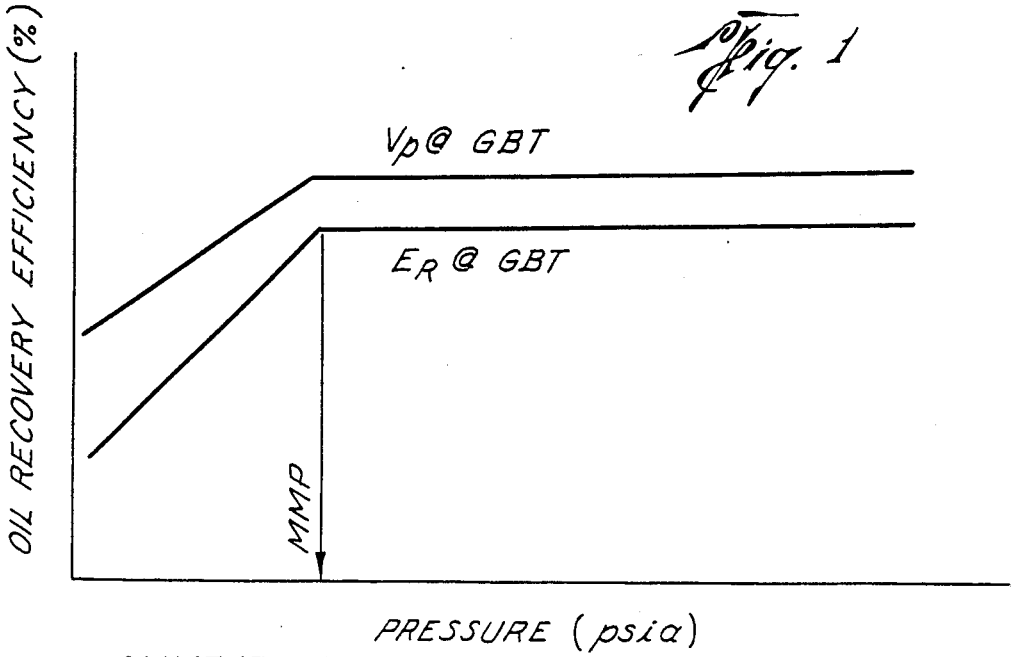
FIG. 1 is a graph showing slimtube results for a carbon dioxide displacement at high temperature.

A multiphase region of certain oil-carbon dioxide systems at temperatures below 120° F. has been observed in single cell PVT tests or flow experiments. FIG. 1 shows a typical slimtube result at high temperature (greater than 120° F.). The result is used to measure minimum miscibility pressure. The minimum miscibility pressure is defined as the lowest pressure at which the oil recovery efficiency at gas breakthrough ($E_R$ @ EBT) becomes pressure independent at pressures above this point. In the same figure, the volume of carbon dioxide injected at gas breakthrough ($V_p$ @ GBT) is also plotted. $V_p$ @ GBT curve for the system without multiphase generation shows parallel changes with the $E_R$ @ GBT.

Figure 2:
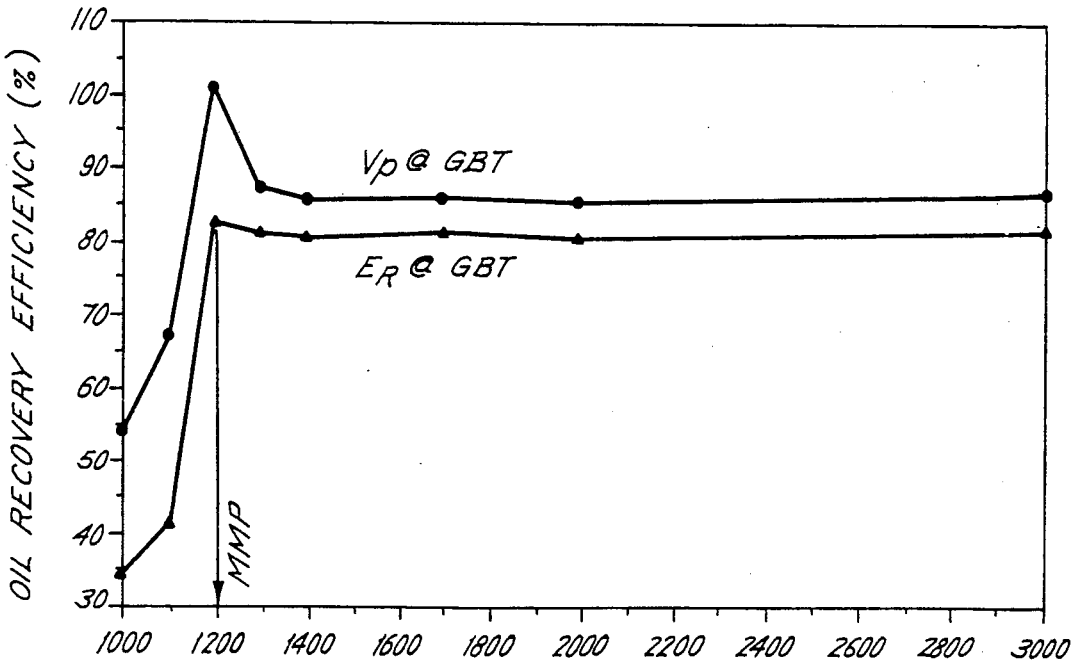
FIG. 2 is a similar graph showing displacement at low temperature which results in the generation of a multiphase region.

The $V_p$ @ GBT curve exhibits different characteristics for certain oil-$CO_2$ systems at temperatures below 120° F. FIG. 2 shows that while the $E_R$ @ GBT still behaves similarly to that at high temperature (FIG. 1), the $V_p$ @ GBT curve exhibits a "hump" near the minimum miscibility pressure. Through a PVT analysis, it can be shown that there is a multiphase generation region near the minimum miscibility pressure where the "hump" exists.

Laboratory coreflood experiments indicate that oil recovery efficiency was improved in the multiphase pressure range. This was evidenced by the following observations:

Multiphase generation reduces mobility within the flow system used because of the observation of increased pressure change during the tests.

FIG. 3 shows the pressure drop history of a carbon dioxide-oil system above the three-phase region and shows a smooth pressure drop. FIG. 4 shows the pressure drop history of a carbon dioxide-oil system in the three-phase region. This second graph shows a pressure "hump" that corresponds to the observation of multiphase in the sight glass. The increased pressure drop in the multiphase generation conditions is due to the reduction of the fluid mobility in this region. The mobility reduction should improve oil recovery efficiency.

The gas breakthrough time is prolonged in the multiphase pressures, especially at the minimum miscibility pressure. The "hump" shown in FIG. 2 indicates that gas breakthrough time is prolonged as compared to FIG. 1 where there is no "hump". The prolonged gas breakthrough time can keep the carbon dioxide in the oil phase longer and therefore improve the oil recovery efficiency. Similar results were observed for the west Texas oils.

Thus the present invention is a method to extend the application of multiphase generation process to high temperature reservoirs which could not otherwise operate under multiphase generation conditions. It is preferred that cold water be injected into the reservoir to precondition the temperature so that when carbon dioxide is injected into the reservoir, the following advantages of multiphase generation can be obtained:

1. a lower minimum miscibility pressure than at a higher temperature;
2. a reduction in carbon dioxide consumption due to the lower minimum miscibility pressure requirement;
3. a reduction in fluid mobility due to multiphase generation and therefore an improved recovery efficiency; and
4. a prolonged gas breakthrough time and therefore a better recovery efficiency.

The temperature profile of the cooled reservoir can be predicted by using the steamflood model THERM. For example, in a 70-foot thick reservoir with an initial temperature of 140° F., if cold water at 75° F. can be injected into the reservoir at 2400 barrels per day for eight years, the temperature of the reservoir can be reduced to less than 120° F. at least 400 feet away from the injection wellbore.

With the injection of water, the reservoir can be converted to the condition which will have multiphase generation capability when the carbon dioxide is injected. This can substantially improve the oil recovery efficiency of the carbon dioxide flood. In addition, a small amount of oil can be recovered during the cold water injection period.

The method of the present invention can be subject to modifications and changes by those skilled in the art. Therefore the scope of the invention is to be determined by the following claims rather than the preceding description.

What is claimed is:

1. A method for achieving multiphase generation conditions for recovery of hydrocarbon products from a high temperature reservoir without reaching minimum miscibility pressure, said reservoir being penetrated by a patterned array of injection and production wells, comprising the steps of:

preconditioning a zone of said high temperature reservoir surrounding an injection well by injecting a sufficient quantity of cool water to lower the temperature of said reservoir to at least the temperature associated with multiphase generation;

creating a multiphase slug by injection of carbon dioxide into said cooled zone; and operating said reservoir with subsequent injections to displace the in situ generated multiphase slug.

2. A method according to claim 1 wherein said reservoir temperature is lowered to a temperature at which multiphase region exists.

3. A method according to claim 2 wherein said temperature is not greater than 120° F.

4. A method according to claim 1 wherein said carbon dioxide is injected in the liquid state.

5. A method according to claim 1 wherein said subsequent injections are more carbon dioxide, carbon dioxide and nitrogen, or water alternating with gaseous carbon dioxide.

6. A method for improved recovery of hydrocarbon products from a high temperature reservoir, said reservoir being penetrated by a patterned array of injection and production wells, comprising the steps of:

preconditioning a zone of said high temperature reservoir surrounding at least one injection well by injecting a sufficient quantity of cool water to lower the temperature of said reservoir in said zone to a temperature suitable for multiphase generation condition, said condition being less than for minimum miscibility pressure;

creating a multiphase slug by subsequent injection of carbon dioxide into said cooled zone; and operating said reservoir with further injections of driving fluid to displace the in situ generated multiphase slug through the reservoir.

7. A method according to claim 6 wherein said reservoir temperature is lowered to a temperature at which multiphase region exists.

8. A method according to claim 7 wherein said temperature is no greater than 120° F.

9. A method according to claim 6 wherein said carbon dioxide is injected in the liquid state.

10. A method according to claim 6 wherein said subsequent injections of driving fluid are more carbon dioxide, carbon dioxide and nitrogen, or water alternating with gaseous carbon dioxide.

* * * * *